United States Patent [19]

Chavaroux

[11] Patent Number: 4,894,030

[45] Date of Patent: Jan. 16, 1990

[54] ELECTRICAL CONNECTOR

[75] Inventor: Patrick R. Chavaroux, Jouy-Le-Moutier, France

[73] Assignee: Raychem Pontoise S.A., France

[21] Appl. No.: 338,486

[22] Filed: Apr. 13, 1989

Related U.S. Application Data

[63] Continuation of Ser. No. 240,990, Sep. 6, 1988, abandoned.

[30] Foreign Application Priority Data

Sep. 4, 1987 [GB] United Kingdom ..... 8720876

[51] Int. Cl.[4] ..... H01R 4/02

[52] U.S. Cl. ..... 439/874; 174/DIG. 8; 439/932

[58] Field of Search ..... 439/874, 932; 174/DIG. 8

[56] References Cited

U.S. PATENT DOCUMENTS

| | | | |
|---|---|---|---|
| 4,264,780 | 4/1981 | Rolland | 174/DIG. 8 X |
| 4,283,596 | 8/1981 | Vidakovits et al. | 174/DIG. 8 X |
| 4,391,921 | 7/1982 | Simpson | 174/DIG. 8 X |
| 4,722,471 | 2/1988 | Gray et al. | 174/DIG. 8 X |

FOREIGN PATENT DOCUMENTS

| | | | |
|---|---|---|---|
| 423958 | 2/1935 | United Kingdom . | |
| 725498 | 3/1955 | United Kingdom . | |
| 1047890 | 11/1966 | United Kingdom . | |
| 1418414 | 12/1975 | United Kingdom | 439/874 |
| 2025157 | 1/1980 | United Kingdom . | |

OTHER PUBLICATIONS

Raychem Devices Brochures MSCD-03-035 and MSCD-03-036.

*Primary Examiner*—Eugene F. Desmond

*Attorney, Agent, or Firm*—Herbert G. Burkard; Simon J. Belcher

[57] ABSTRACT

An electrical connector for forming an electrical solder connection comprises an electrically insulating open-ended sleeve 2 which is preferably heat-shrinkable, a pre-installed conductor 5 e.g. for forming an earth connection or for forming a connection to a pcb, and a quantity of solder 3 for forming an electrical connection between the pre-installed conductor and another conductor that is received in the sleeve. The pre-installed conductor has a region of non-uniform cross-section, for example produced by crimping, that will be contacted by the solder when the connection is formed and which increases the force required to pull the two conductors apart.

4 Claims, 2 Drawing Sheets

Fig. 4a.
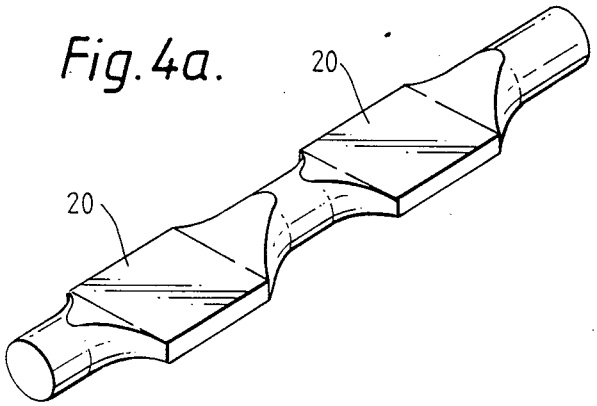
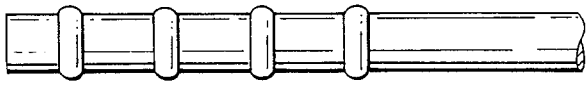
Fig. 4b.
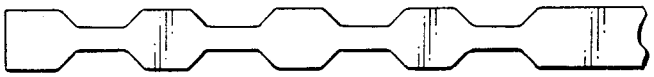
Fig. 4c.

ELECTRICAL CONNECTOR

This application is a continuation of application Ser. No. 07/240,990, filed Sept. 6, 1988, now abandoned.

This invention relates to electrical connectors, in particular to connectors for forming solder connections, and to connections formed by means of such connectors.

In particular the invention relates to such devices that are dimensionally heat-recoverable.

Heat-recoverable articles are articles the dimensional configuration of which may be made substantially to change when subjected to heat treatment.

Usually these articles recover, on heating, towards an original shape from which they have previously been deformed but the term "heat-recoverable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962; 3,086,242 and 3,597,372. As is made clear in, for example, U.S. Pat. No. 2,027,962, the original dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate stage.

In the production of heat-recoverable articles, the polymeric material may be cross-linked at any stage in the production of the article that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

Heat-recoverable articles have become widely used for forming solder connections between electrical conductors in view of the ease of forming the connection and the quality of the connection so formed. For such applications the article, usually in the form of a sleeve, contains a quantity of solder for forming the electrical connection and a pair of fusible inserts for sealing the connection. These articles are described for example in U.S. patent specifications Nos. 3,243,211, 4,282,396 and 4,283,596, and British Patent No. 1,470,049 the disclosures of which are incorporated herein by reference, and are sold by Raychem Corporation, Menlo Park, California under the trade mark "SOLDER SLEEVE' amongst others.

In some forms of connector an electrical conductor to be connected may be pre-installed in the device. This type of connector is useful e.g. for forming electrical connections between the screen of a shielded cable or coaxial cable and earth, or for terminating wires and cables at printed circuit boards.

According to the present invention, there is provided an electrical connector for forming an electrical solder connection, which comprises an electrically insulating open-ended sleeve that is capable of receiving an electrical conductor, the sleeve having a pre-installed elongate electrical conductor that extends beyond the sleeve and a quantity of solder for forming an electrical connection between the conductors, wherein the pre-installed conductor has a region which will be contacted by the solder when the connection is formed and which has a cross-section that changes along its length so as to increase the force required to pull the two conductors apart in the completed solder connection.

The connector has the advantage that it is possible to improve the axial strength of the completed solder connection significantly, for example by at least 10%, and preferably at least 20%.

The pre-installed conductor may be stranded or solid (single strand), preferably solid, and may be formed from any suitable metal or alloy, e.g. bare copper, tin plated, or nickel plated or silver plated copper, aluminium, steel and the like, and preferably from tinned copper or silver plated copper.

The cross-section of the pre-installed conductor may be made to vary by conventional means such as crimping, whether the conductor be solid or stranded. In other instances it is possible that a conductor may be stamped from a sheet of metal, in which case would have a uniform thickness and a variable width. Preferably, however, the pre-installed conductor is formed from a solid wire and has been crimped in order to flatten areas of the conductor while leaving alternating areas with substantially the original cross-section. Alternatively the conductor may be subjected to an operation, e.g. rolling, in which the crosssection of the conductor remains circular, but the diameter of the conductor varies periodically along its length. In yet another form of device the conductor may be crimped so that it has a substantially "zig-zag" shape as viewed from the side.

The term "solder" as used herein includes both conventional metallic solder and solder adhesives in which a hot-melt adhesive, e.g. a polyamide hot-melt adhesive, or a thermosetting adhesive such as an epoxy adhesive, is filled with metal particles, e.g. with silver flake. In most cases, however, the solder inserts will be formed from conventional metallic solder. If desired, more than one form of solder may be employed, for example a low melting point solder such as a 63% Sn/37% Pb eutectic may be used in conjunction with a high melting point solder such as a 6.5% Sn/3.5% Ag eutectic, as described in our European patent application No. 85401437.0 or our British patent application No. 8710489 the disclosures of which are incorporated herein by reference.

Several embodiments of the invention will now be described by way of example, with reference to the accompanying drawings, in which:

FIGS. 4*a*–4*c* show various forms of pre-installed lead for use with the connectors according to the invention.

Figure 1:
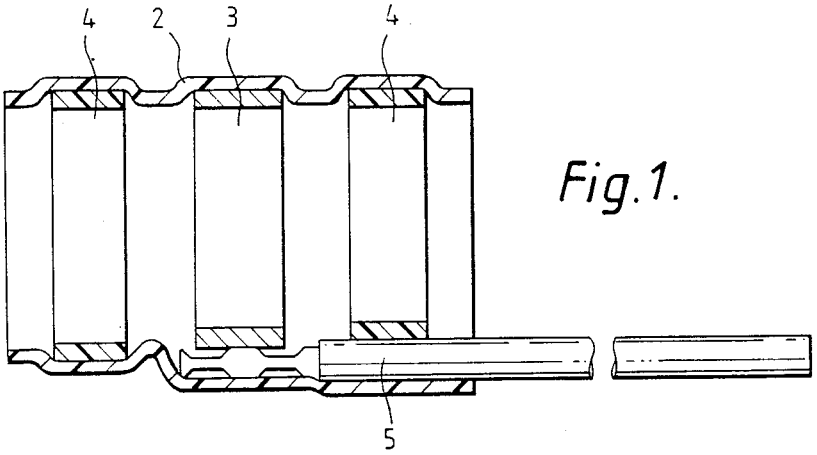
FIG. 1 is a sectional view along the axis of one form of connector in accordance with the present invention.

Referring to the accompanying drawings FIG. 1 shows a heat shrinkable solder connector which comprises a sleeve 2 formed from a heat-shrinkable polymeric material e.g. polyvinylidine fluoride, a fluxed solder ring 3, and two fusible sealing rings 4 formed for example from uncrosslinked polyethylene. The connector which is designed for forming an earth connection to the screen of a screened cable, includes a preinstalled earth lead 5 which is electrically insulated except for its end region in the proximity of the solder ring 3. The profile of the end of the lead 5 is as shown in FIG. 4*a* and has a number of flat areas 20 of increased width which have been formed by a crimping operation.

The connector is installed by positioning it over an appropriately stripped cable and heating it to recover the sleeve 2, melt the solder ring 3 and cause it to flow around the cable screen and the end of the pre-installed lead 5, and to melt the sealing rings 4. Once the device has been installed the periodically changing cross-section of the part of the lead 5 that is encapsulated in the solder locks the lead in place and significantly improves the tensile force required to pull the lead out.

Figure 2:
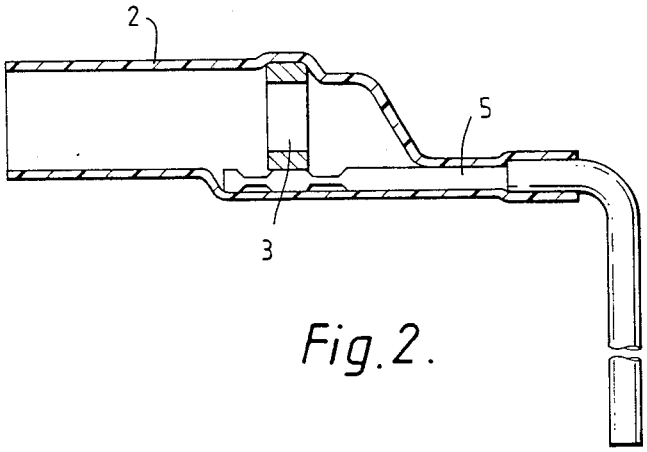
FIG. 2 is a sectional view along the axis of another form of connector.

FIG. 2 shows a heat shrinkable solder connector for terminating a wire to a printed circuit board (pcb) which comprises a heat shrinkable sleeve 2, solder ring 3 and solid tinned copper lead 5 which is bent into a right angle for insertion into a pcb connection hold. The end of the lead 5 in the region of the solder ring 3 is profiled as shown in FIG. 4*a* in order to increase its pull-out resistance as described above.

Figure 3:
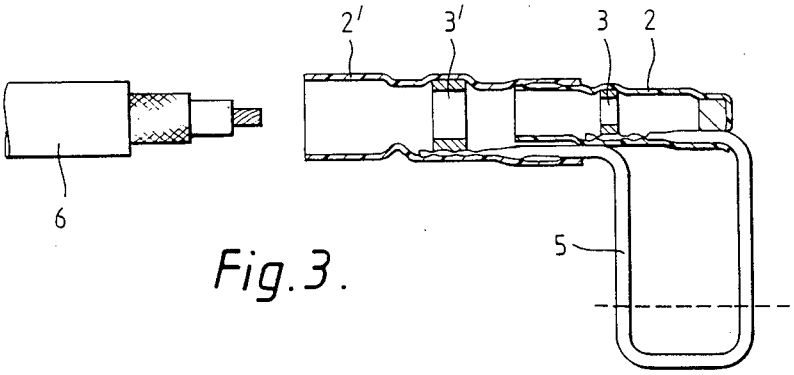
FIG. 3 is a sectional view along the axis of yet another form of connector.

FIG. 3 shows a device for connecting a coaxial cable to a pcb. The device comprises a pair of heatshrinkable polyvinylidene fluoride sleeves 2 and 2' each containing a solder ring 3 and 3' and one end region of a looped connection lead 5. The device can be installed simply by inserting an appropriately stripped coaxial cable 6 into the open end of the sleeve 2' and heating the device with a hot-air gun to recover the sleeves 2 and 2' and to cause the solder rings 3 and 3' to melt and connect the ends of the lead 5 with the central conductor and the screen of the coaxial cable respectively. The lower portion of the looped lead, below the dotted line as shown in the drawing, is removed by means of a pair of snips to leave two right angled connection leads that can be inserted into corresponding holes in a pcb.

FIG. 4*a* shows one form of profile for a preinstalled lead used in the present invention which has been forwarded by crimping a uniform cylindrical lead. FIG. 4*b* shows another form of lead which has been formed by rolling a cylindrical lead, and FIG. 4*c* shows yet a further profile that may be stamped out of a sheet of metal.

I claim:

1. An electrical connector for forming an electrical solder connection, which comprises an electrically insulating open-ended sleeve that is capable of receiving an electrical conductor, the sleeve having a pre-installed elongate electrical conductor that extends beyond the sleeve and a quantity of solder for forming an electrical connection between the conductors, wherein the pre-installed conductor has a region which will be contacted by the solder when the connection is formed and which has a cross-section that changes along its length so as to increase the force required to pull the two conductors apart in the completed solder connection.

2. A connector as claimed in claim 1, wherein the pre-installed conductor has been crimped in order to vary its cross-section along its length.

3. A connector as claimed in claim 2, wherein the conductor has areas that have been flattened and alternating areas that have not been flattened.

4. A connector as claimed in claim 1, wherein the sleeve is dimensionally heat-recoverable.

* * * * *